United States Patent [19]

McCaney et al.

[11] 4,213,387

[45] Jul. 22, 1980

[54] CAN CRUSHER

[76] Inventors: Carlos P. McCaney, 20119 S. Hillford, Carson, Calif. 90746; Ronald W. Bocksruker, 11408 Albata St., Los Angeles, Calif. 90049

[21] Appl. No.: 42,588

[22] Filed: May 24, 1979

[51] Int. Cl.[2] ..... B30B 1/04; B30B 7/00

[52] U.S. Cl. ..... 100/245; 100/DIG. 2; 100/218; 100/280; 100/283; 100/293; 100/295

[58] Field of Search ..... 100/DIG. 2, 218, 295, 100/293, 245, 280, 283, 281, 286, 240; 241/99, 262, 263; 99/568, 581

[56] References Cited

U.S. PATENT DOCUMENTS

| | | | |
|---|---|---|---|
| 2,128,630 | 8/1938 | Wright | 100/245 |
| 2,737,995 | 3/1956 | Jennings | 100/DIG. 2 |
| 3,889,587 | 6/1975 | Wharton | 100/DIG. 2 |
| 4,133,261 | 1/1979 | Belfils | 100/280 |
| 4,143,595 | 3/1979 | Carlson | 100/280 |

*Primary Examiner*—Billy J. Wilhite

*Attorney, Agent, or Firm*—Poms, Smith, Lande & Rose

[57] ABSTRACT

A can crusher having an upstanding stationary platen and an upstanding movable platen, the movable platen being reciprocated with respect to the stationary platen. Both platens are canted with their upper ends closer together than their lower ends so that, when a can is placed in the crusher with the can in contact with the platens, the platens trap and hold the can in the crusher and concentrate the crushing forces over a narrow portion of the can perimeter at the beginning of the crushing of the can resulting in a reduction in the total force required to crush the can.

10 Claims, 6 Drawing Figures

10
11
12
13
16
19
20
22
24
25
28
30
32
33
34
35
36
37
38
39
41
43
44
46
47
48
49
50
51
52
55
56

10
11
12
16
19
20
22
24
25
32
33
34
35
36
37
38
39
41
43
44
46
47
48
49
50
51
52
55
56

CAN CRUSHER

BACKGROUND OF THE INVENTION

1. FIELD OF THE INVENTION

The invention relates to can crushers; and, more particularly, to an improved can crusher which is capable of crushing commercial beverage cans of all sizes up to 16 fluid ounces in a quick and efficient manner.

2. DESCRIPTION OF THE PRIOR ART

Beverage cans have been a continuing problem in today's ecology minded society. In recent years, it has been proposed to recycle such cans but such recycling requires temporary storage until the cans can be brought to a recycling center. Needless to say, the cans take up quite a bit of storage volume and various can crushing devices have been suggested to reduce can storage volume. Although side can crushing devices are known, cans crushed with devices of this type are dangerous to handle since the side crushing results in exposed sharp edges. Also, such side crushed cans do not store well since the ends are not as compacted as the center.

Vertical crushing is thus more desirable but great pressure is required to compress a can vertically. Heretofore, vertical can compression devices are quite bulky and expensive, e.g., the device of the Wharton patent, U.S. Pat. No. 3,889,587. One recent patent to Belfils, U.S. Pat. No. 4,133,261, discloses a device which has a base on which the can to be crushed is placed with means for crimping one side of the can when pressure is applied to the top. The crimping is accomplished by a bead on the bottom base. However, the Belfils device requires considerable force to crush the can and, since the crimping means is provided by a bead, will result in crushed cans of varying size variations requiring differing degrees of pressure. Also, as seen in FIG. 2 of Belfils, since the upper end of the can is not restrained laterally be platen 6, tall cans, e.g. 16 oz. cans, will buckle into a wide variety of random shapes. Since the can is not restrained laterally, it may be forcibly ejected during crushing resulting in injury to the user. Also, the crushed can of Belfils must be removed manually and may have sharp edges. Since the can is not confined, the device of Belfils must be operated in a vertical orientation and the can must be carefully and properly positioned.

There is thus a need for a can crusher which is capable of uniformly crushing all commercial beverage cans up to and including 16 fluid ounces with less force than prior devices with automatic ejection of the crushed can.

SUMMARY OF THE INVENTION

It is an object of this invention to provide a can crusher which requires less force than known devices for crushing cans.

It is further object of this invention to provide a crusher which is operated by a lever to crush a can therebetween in a uniform and compact manner.

It is still further an object of this invention to provide a can crusher which securely traps a can to be crushed and holds the can securely during crushing.

It is even further an object of this invention to eject the crushed can automatically after crushing.

These and other objects are preferably accomplished by providing an upstanding stationary platen and an upstanding movable platen, the movable platen being reciprocated with respect to the stationary platen. Both platens are canted with their upper ends closer together than their lower ends so that, when a can is placed in the crusher with the can in contact with the platens, the platens trap and hold the can in the crusher and concentrate the crushing forces over a narrow portion of the can perimeter at the beginning of the crushing of the can resulting in a reduction in the total force required to crush the can.

DESCRIPTION OF THE PREFERRED EMBODIMENT

Figure 1:
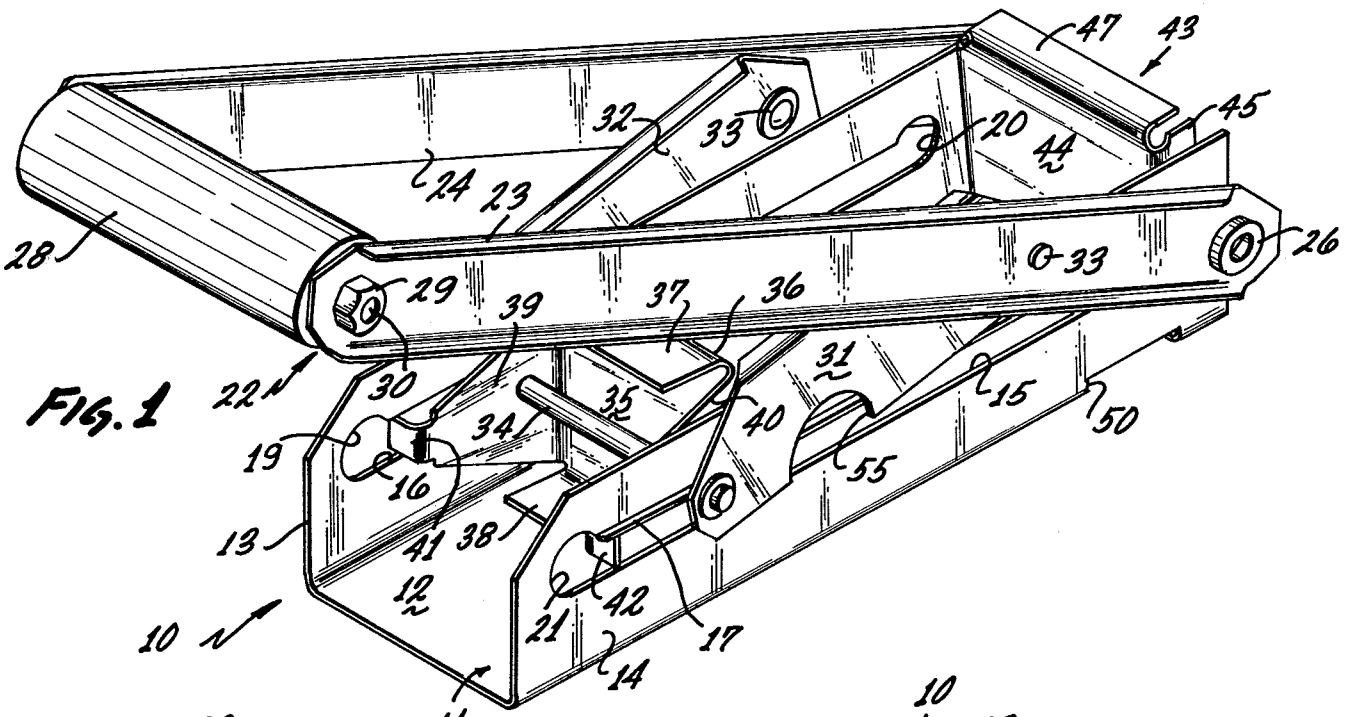
FIG. 1 is a perspective view of a can crusher of the present invention.

Referring now to FIG. 1 of the drawing, a can crusher 10 is shown in accordance with the invention having a frame 11 formed of a planar bottom wall 12 and a pair of spaced upstanding side walls 13,14. An elongated slot 15 is provided in side wall 14 and a like elongated slot 16 is provided in side wall 13. An elongated rib 17,18 extends on the outside of each wall 13,14 above each slot 15,16 (see also FIG. 2). Each slot 15,16 terminates in an enlarged end portion (portions 19,20 on slot 16 and portion 21 on slot 15-the other slot 15 not being visible in FIG. 1).

Figure 2:
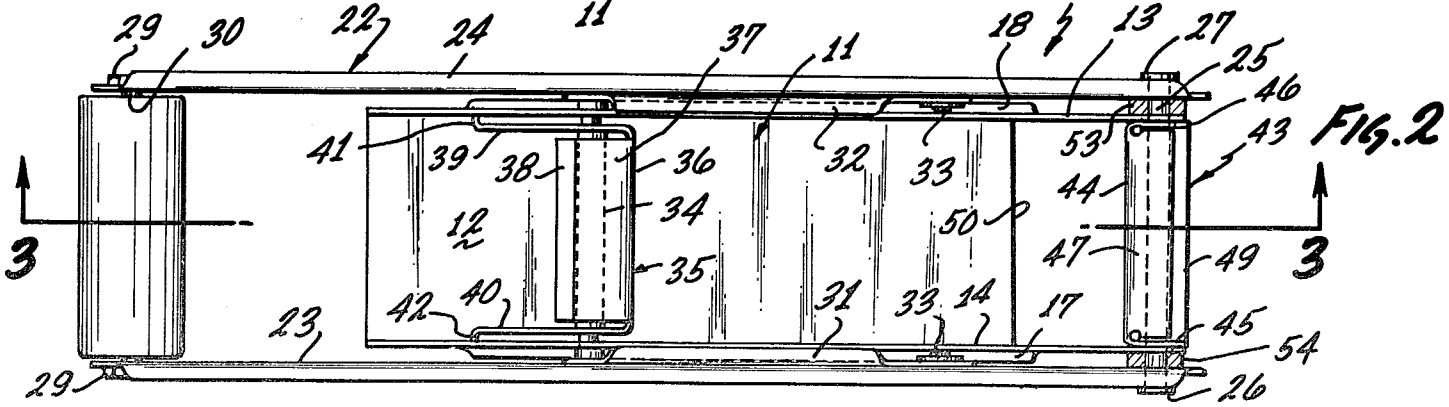
FIG. 2 is a top plan view of the can crusher of FIG. 1.

An operating lever 22 is provided having a pair of spaced arms 23,24 pivotally mounted to the outside of each side wall 13,14. A single pin 25 (FIG. 2) may be used to pivotally mount arms 23,24 with nuts or other suitable locking means 26,27 used to secure arms 23,24 to pin 25. A handle portion 28 interconnects the free ends of spaced arms 23,24; nuts 29 (FIG. 1) being secured to threaded ends of shaft 30 (FIG. 2).

A pair of links 31,32 are interconnected intermediate the ends of each arm 23,24 by lock pins or rivets 33 or the like. The free ends of each link 31,32 is connected to a cross pin 34 passing out of each slot 15,16 (FIG. 1).

A movable platen 35 is mounted between side walls 13,14 and includes an upstanding main wall portion 36 (See FIGS. 3 and 4) having upper and lower horizontal flanges 37,38, respectively, and a pair of generally triangularly shaped spaced side walls 39,40 terminating in ears 41,42, respectively, extending generally normal to walls 39,40, entering slots 15,16 respectively. Pin 34 passes through side walls 39,40. As seen in FIG. 1, it can be appreciated that, when lever 22 is actuated, links 31,32 move to position pin 34 against ears 41,42. As will be discussed, ears 41,42 maintain platen 35 in a position canted slightly from the vertical (see face 36 in FIGS. 3 and 4, for reasons to be discussed.

Figure 3:
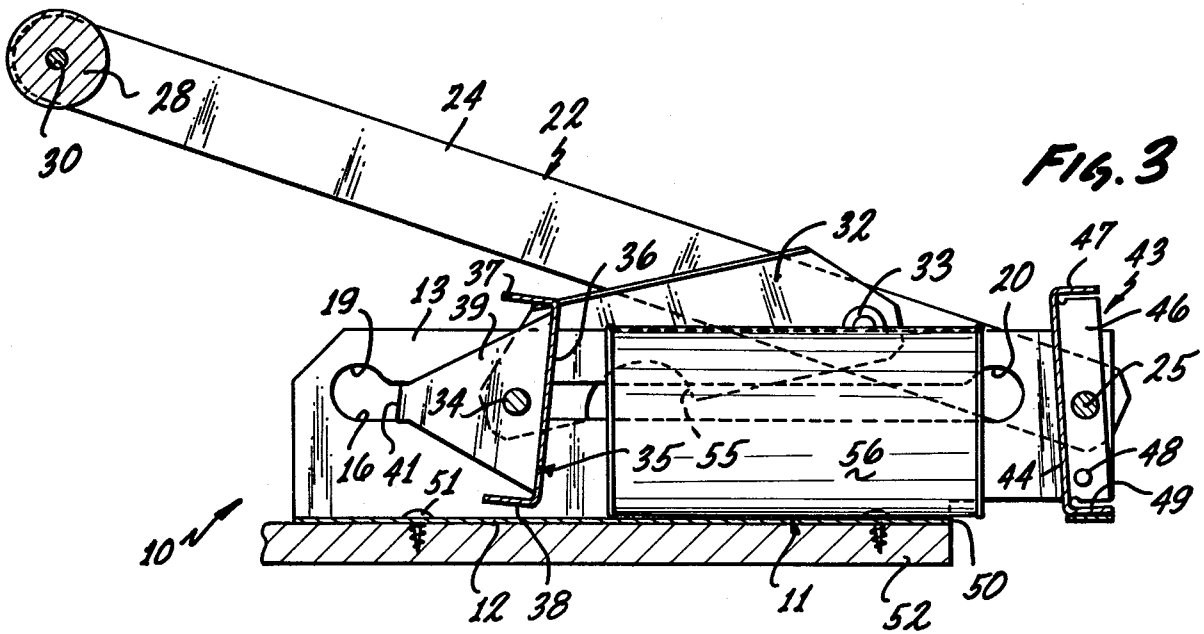
FIG. 3 is a view taken along lines 3—3 of FIG. 2.
Figure 4:
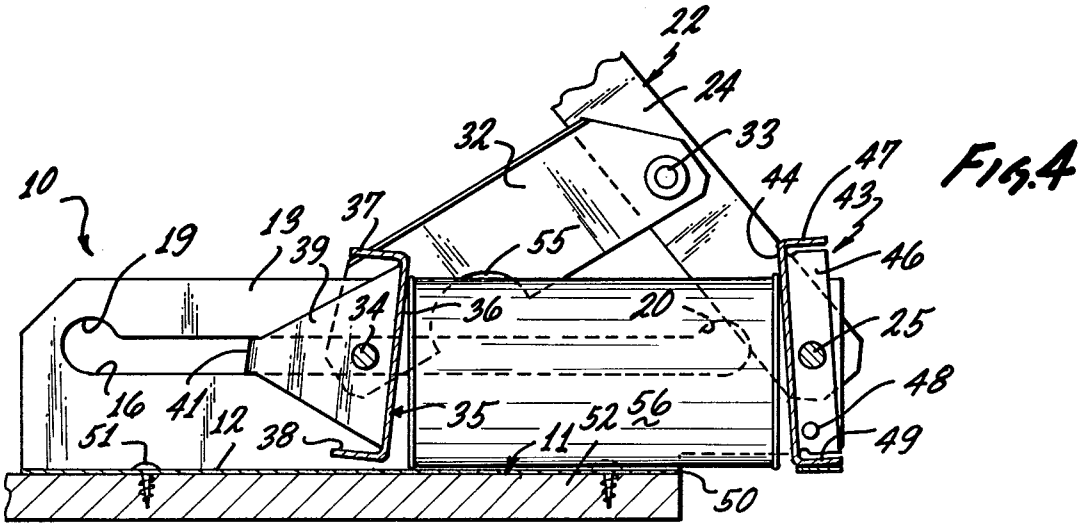
FIG. 4 is a view similar to FIG. 3 illustrating the operation thereof.

Crusher 10 also includes a front stationary platen 43 having a vertical face portion 44 having spaced side flanges 45,46 and an upper generally horizontal flange 47. Pin 25 (FIG. 2) passes through suitable apertures in side flanges 45,46 so that platen 43 is rotatably mounted. As seen in FIGS. 3 and 4, rivets 48 may be used to mount platen 43 to frame 11 so that it is maintained in a position whereby face portion 44 is slightly canted from the vertical (as shown particularly in FIGS. 3 and 4). Platen 43 also includes a bottom flange 49 (FIGS. 3 and 4) parallel to upper flange 47.

As seen in FIGS. 1 and 2, a slot 50 is formed in bottom wall 12 adjacent platen 43.

As seen particularly in FIGS. 3 and 4, each face portion 36,44 of platens 35 and 43 is canted from the vertical in opposite directions with can 56 about to be crushed. Thus, each face portion 36,44 is offset a predetermined distance from the vertical, preferably about 1/16 th per inch of length in a manner such that the upper edges of the platens 35,43 are closer together than the lower edges thereof.

As shown in FIG. 3, a can may be placed in crusher 10 between platens 35 and 43. When handle 28 is lowered, pin 34 moves along slots 15,16 (via links 31,32) which thus moves platen 35 toward platen 43. Each ear 41,42 moves along its respective slot (see ear 42 in slot 15 in FIG. 4) thus maintaining face portion 36 in its canted position. Also, as shown in FIGS. 3 and 4, crusher 10 may be screwed or otherwise secured to a supporting surface. For example, suitable apertures may be provided in bottom portion 12 for receiving one or more screws 51 threading into a support 52. Opening 50 in bottom wall 12 is disposed at the end of the support 52 for reasons to be discussed. Also, as shown in FIG. 2, cylindrical spacers 53,54 may be provided between arms 23,24 and side walls 13,14 to maintain the handle 22 in a centered position. Also, each link 31,32 includes an arcuate cut-out portion 55 for reasons to be discussed.

Figure 5:
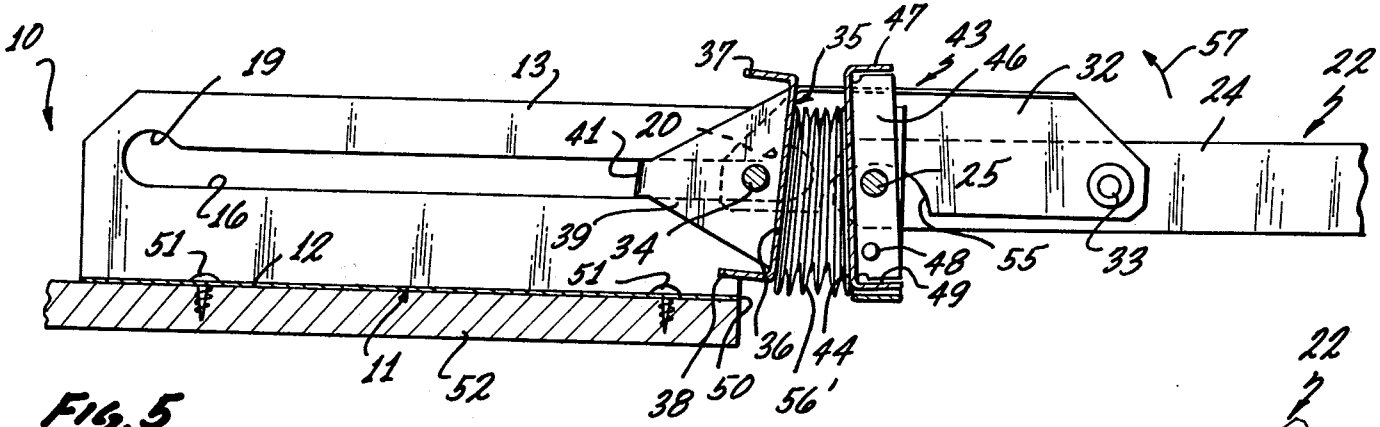
FIG. 5 is a side view of the can crusher of FIG. 1 mounted on a supporting surface illustrating the crushing of a can.
Figure 6:
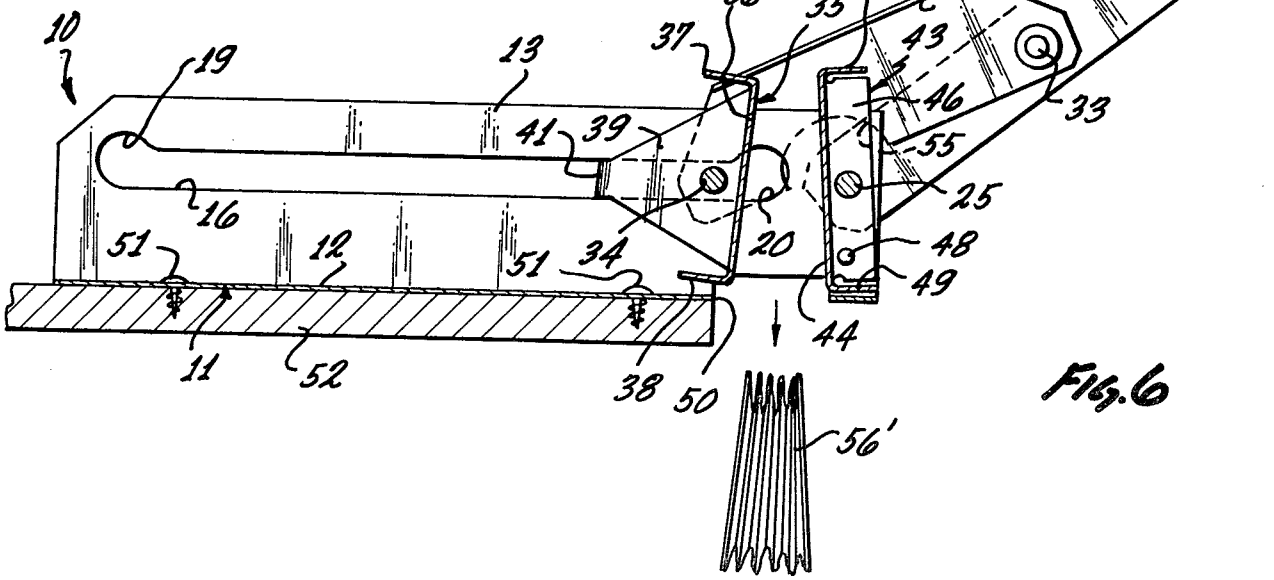
FIG. 6 is a view similar to FIG. 5 illustrating the automatic ejection of a crushed can after crushing thereof.

FIG. 5 illustrates the actual crushing of can 56. It can be seen that handle 22 has been rotated to a generally horizontal position from the FIG. 3 position (arcuate portions 55 straddling pin 25). The upper ends of the canted face portions 36,44 are closer than the lower ends thereof crushing can 56' therebetween and forming a tapered crushed can (wider at the bottom than at the top) adjacent opening 50. When handle 22 is returned to the FIG. 3 position (e.g., rotating it in the direction of arrow 57 in FIG. 5), as shown in FIG. 6, crushed can 56' is automatically released from engagement with platens 35,43 and ejected out of opening 50.

Any conventionally shaped beverage can of any size up to and including 16 fluid ounces can be crushed. The platens, being canted, accomplish three things. The angular offsetting of the platens securely traps and holds the can to be crushed safely within crusher 10 so that the can being crushed is prevented from being expelled from the confines of the crusher (e.g., walls 12, 13 and 14) by the high forces developed within the can and crusher 10 during crushing of the can. The offsetting of platens 35,43 forces the can being crushed into firm engagement with the bottom wall 12 of crusher 10 during the crushing stroke of platen 35 resulting in crushed containers of very uniform similarity as shown in FIGS. 5 and 6. The offset angle of faces 36,44 of platens 35,43 serves to concentrate the crushing forces, especially at the onset of the collapse of the can, over a narrow portion of the container perimeter resulting in a great reduction of the total maximum force required to initiate and continue the collapse of the can.

Each platen 35,43 is offset at a small angle from the vertical, e.g. between zero degrees to ten degrees, so that the upper edges of the platens are closer than the lower edges as previously discussed. There is a dramatic reduction in can volume reducing the bulk volume for more efficient handling and storage.

The linkage system involved acts as a toggle linkage producing a large mechanical advantage when approaching the FIG. 5 position. This allows the operator of crusher 10 to develop the high forces needed to complete the crush of a can to its final dimension with modest operator effort exerted at the hand grip 28 end of the linkage system.

It can be seen that a can crusher is disclosed which reduces the force required to crush a can. There is no need for vent holes or an elaborate crusher as in prior art devices. Mechanical advantage is used to crush the cans from their original volume to a uniform crushed configuration. The crushed cans are ejected automatically and no handling by the operator is necessary. No precise alignment of the can to be crushed is necessary; the can is merely casually positioned in the crusher. A new and efficient can crusher is thus disclosed.

We claim:

1. A can crusher comprising:

a frame having a bottom wall including a front edge, a rear edge and a pair of side edges, said side edges being parallel to the principal axis of said bottom wall, said frame also having an upstanding sidewall affixed to each of said side edges, an open front and an open rear, each of said sidewalls being provided with an elongated slot extending from a point adjacent said open front, said bottom wall being provided with a can discharge opening adjacent said open front;

a first platen affixed to said frame at said open front and in front of said can discharge opening;

a second platen reciprocably mounted in said slots for movement from a point adjacent said open rear to a point adjacent said first platen;

an operating handle including a pair of operating levers each having first and second ends;

a pivot pin swingably connecting one end of each of said levers to said frame adjacent said first platen;

a hand grip affixed to the other end of each of said levers; and a pair of links, each of said links having one end swingably connected to an associated one of said operating levers intermediate its ends and another end swingably connected to said second platen for reciprocating said second platen.

2. In the crusher of claim 1 wherein each of said platens are offset slightly from the vertical with the upper ends of each of said platens being closer together than the bottom ends thereof.

3. In the crusher of claim 2 wherein each of said platens are offset in opposite directions from each other.

4. In the crusher of claim 2 wherein said platens are offset about one sixteenth of an inch per inch of length thereof.

5. In the crusher of claim 2 wherein said second platen includes means cooperating with said slots for maintaining said second platen in its offset position slightly offset from the vertical during reciprocation thereof.

6. In a can crusher of the type having an upstanding fixed platen, an upstanding movable platen and means for reciprocating said movable platen with respect to said fixed platen, the improvement which comprises:

means for maintaining said platens in canted positions with their upper ends closer together than their lower ends, whereby, when a can is placed in said crusher with the ends of the can in contact with associated ones of said platens, said platens will trap and hold said can within the crusher during the crushing operation and will concentrate the crushing forces over a narrow portion of the can perimeter at the onset of the can collapse resulting in a reduction of the total maximum force required to initiate and then continue the collapse of the can into accordian-type folds as the can is reduced in size from its normal height to a greatly reduced height, the final collapsed shape of said can being generally trapezoidal in cross-section.

7. In the crusher of claim 6 wherein said means for maintaining said platens in canted positions comprises said crusher having a frame and said fixed platen being fixedly connected to said frame so that a generally vertical face thereof faces said movable platen with the generally vertical of said fixed platen being canted in a direction with the upper edge thereof being closer to the upper end of said movable platen than to the lower end thereof.

8. In the crusher of claim 7 wherein said frame includes a pair of spaced upstanding side walls interconnected by a bottom wall, a slot extending longitudinally of each of said side walls, and a pin reciprocal in said slots, said pin being connected to said movable platen with said movable platen having flanges extending into said slots and movable therealong, said flanges maintaining a generally vertical face of said movable platen during its reciprocation in its canted position whereby the upper end thereof is closer to the upper end of said fixed platen than the lower end thereof is to the lower end of said fixed platen.

9. In the crusher of claim 8 wherein said pin is connected to a pair of spaced links, said links having their free ends pivotally connected to spaced arms intermediate their free ends, said spaced arms interconnected at one free end by a pin passing through both said frame and said fixed platen and at the other free end by a handle.

10. In the crusher of claim 9 wherein each of said platens are canted about one sixteenth of an inch per inch of length thereof from the vertical.

* * * * *